United States Patent [19]

Ohtake et al.

[11] Patent Number: 4,899,120

[45] Date of Patent: Feb. 6, 1990

[54] ELECTROMAGNETIC CONTACTOR

[75] Inventors: Shigeaki Ohtake; Kuniyuki Kogawa; Takato Hirota, all of Kanagawa, Japan

[73] Assignee: Fuji Electric Co., Ltd., Kanagawa, Japan

[21] Appl. No.: 220,035

[22] Filed: Jul. 13, 1988

[30] Foreign Application Priority Data

Jul. 24, 1987 [JP] Japan ..... 62-113394[U]

[51] Int. Cl.[4] ..... H01H 67/02

[52] U.S. Cl. ..... 335/132; 335/202

[58] Field of Search ..... 335/131, 132, 133, 202, 335/120, 160, 134–135; 200/50 C, 293, 295

[56] References Cited

U.S. PATENT DOCUMENTS

| | | | |
|---|---|---|---|
| 3,873,952 | 3/1975 | Kondo et al. | 335/132 |
| 4,254,316 | 3/1987 | Landon | 335/132 |
| 4,508,443 | 4/1985 | Matsuzaki et al. | 354/402 |

FOREIGN PATENT DOCUMENTS

| | | |
|---|---|---|
| 336265 | 4/1987 | Fed. Rep. of Germany . |
| 51-147041 | 11/1976 | Japan . |
| 59-107310 | 6/1984 | Japan . |
| 60-129717 | 7/1985 | Japan . |
| 62-264034 | 11/1987 | Japan . |

*Primary Examiner*—Leo P. Picard
*Assistant Examiner*—Lincoln Donovan
*Attorney, Agent, or Firm*—Finnegan, Henderson, Farabow, Garrett and Dunner

[57] ABSTRACT

An electromagnetic contactor includes an arc-extinction cover that prevents an electric arc generated during the disconnection of a fixed contact and a movable contact for bridging adjacent fixed contacts. A removable terminal cover serves to cover terminal screws attached to the fixed contacts. The arc-extinction cover and the terminal cover are separate from the contactor body and are attachable and detachable.

10 Claims, 4 Drawing Sheets

ELECTROMAGNETIC CONTACTOR

FIELD OF THE INVENTION

The present invention is directed to an insulating terminal cover of an electromagnetic contactor, which is incorporated in an electric path in an electric motor and is intended to control the electric path by opening and closing it.

DESCRIPTION OF THE INVENTION

FIGS. 5, 6, and 7 in combination illustrate a well-known triple-pole electromagnetic contactor that includes one auxiliary contact point. A body casing 1 is formed of synthetic resin and has side walls 1*a*. Provided between these side walls are partition walls 1*b* that define insulating sections, the number of which corresponds to the number of poles. Fixed contacts 3 having screw terminals 2 are provided between the side walls 1*a* and the neighboring partition walls 1*b* and between the respective partition walls 1*b*, as depicted in FIG. 6. A movable contact support 4 is guided to be slidable on the axial line of the body casing in a guide groove 1*c* formed between the fixed contacts 3.

The movable contact support 4 is formed with a window 4*a* extending in the longitudinal direction of the fixed contacts 3. In the window 4*a*, a movable contact 5 including contact points 5*a* for bridging and releasing fixed contact points 3*a* of the fixed contacts 3 is supported together with a contact spring 6. The movable contact support 4 is linked to a movable iron core 7 (See FIG. 7) of a driving electromagnet accomodated in the body casing 1.

The partition walls 1*a* on both sides and the interpole partition walls 1*b* of the body casing 1 are, as depicted in FIG. 7, integrally formed with arc-extinction partition walls 1*e* and terminal covers 1*g*. Guide grooves 1*d* for positioning the fixed contacts 3 are formed on the inner sides of the side walls 1*a* and on both sides of the partition walls 1*b*. Arc-extinction partition walls 1*e* are provided to separate the spaces for the contact points 3*a* of the fixed contacts 3 and the screw terminals 2. The terminal covers 1*g* cover the screw terminals 2. The terminal covers 1*g* have through-holes through which head portions of terminal screws 2*a* may be observed.

When a voltage is impressed on an exciting coil (not shown) in the electromagnetic contactor, the movable iron core 7 is attracted by a fixed iron core (not shown). As a result, the movable contact support 4 is lowered in FIG. 6, and the movable contact 5 functions to bridge the fixed contacts 3. Subsequently, a load, e.g., the electric motor is energized. Upon the termination of the voltage applied to the exciting coil, the movable iron core 7 reverts to its original position under the influene of the return spring 6, to cause the movable contact 5 to move away from the fixed contacts 3. When the contact points 5*a* of the movable contact 5 are separated from the contact points 3*a* of the fixed contacts 3, an electric arc is generated between the contact points 5*a* and 3*a*. The electric arc is hindered by the arc-extinction partition walls le from reaching the terminal screws 2*a*.

In the conventional device, the body casing 1 is integrall formed with the terminal covers 1*g*, and the terminal screws 2*a* cannot be removed. Consequently, it is impossible to make a connection by employing an R-shaped contact bonding terminal provided with a doughnut-like contact portion whose tip part undergoes penetration of the terminal screw 2*a*. In some cases, the movable contact 5 must be replaced depending on the working condition or when the contactor is examined. However, because the body casing 1 and the arc-extinction partition walls 1*e* are formed as an integrated unit, the movable contact 5 cannot be replaced from the bilateral directions in FIG. 6. The replacement of the movable contact 5 involves disassembly of the electromagnetic contactor which requires much labor. Moreover, some applications do not need the terminal covers 1*g* thus making it necessary to manufacture separately electromagnetic contactors having no terminal cover.

SUMMARY OF THE INVENTION

An object of the present invention is an electromagnetic contactor having contact terminals that are freely replaceable.

Another object of the present invention is an electromagnetic contactor that does not require a terminal cover.

A further object of the present invention is an electromagnetic contactor that accommodates a variety of terminal fittings.

These and other objects are accomplished by an electromagnetic contactor comprising a contactor body, a plurality of fixed contacts, each of the fixed contacts having a terminal end and a contact end, a plurality of movable contacts, each of the movable contacts being associated with a different one of the fixed contacts for making an electrical connection at a contact point with the contact end of the associated fixed contact, and arc-extinction cover means for preenting electrical arcing between the contact point and the terminal end of the fixed contacts, the arc-extinction cover means being detachably secured to the contactor body.

BRIEF DESCRIPTION OF THE DRAWINGS

The manner by which the above objects and other objects, features, and advahtages of the present invention are accomplished will be apparent when the following detailed description is considered in view of the drawings, wherein.

DETAILED DESCRIPTION OF THE PREFERRED EMBODIMENT

Figure 1:
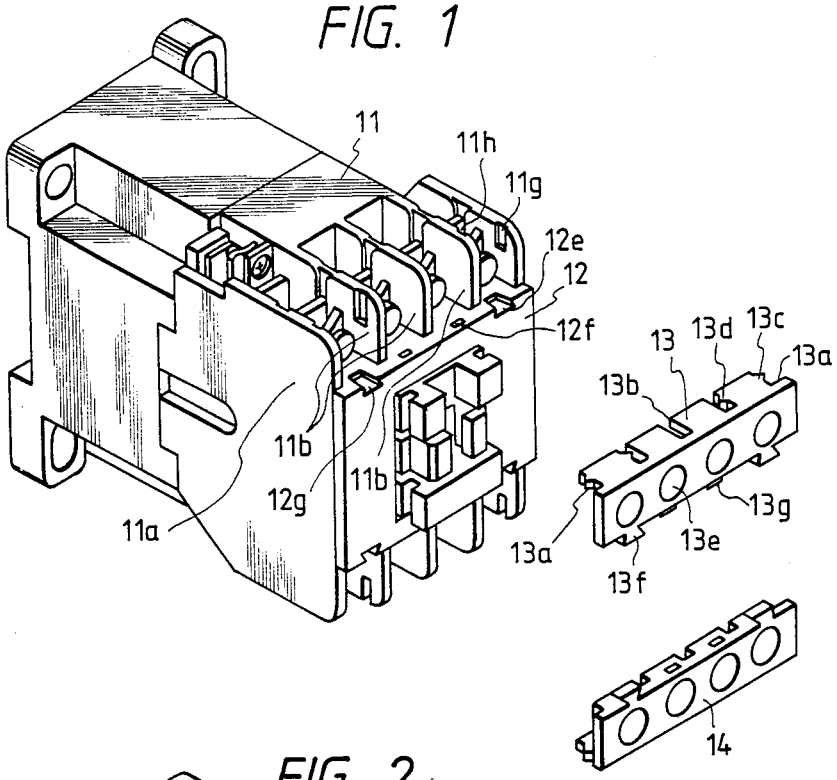
FIG. 1 is an exploded perspective view of the electromagnetic contactor of the present invention with the terminal covers detached.
Figure 2:
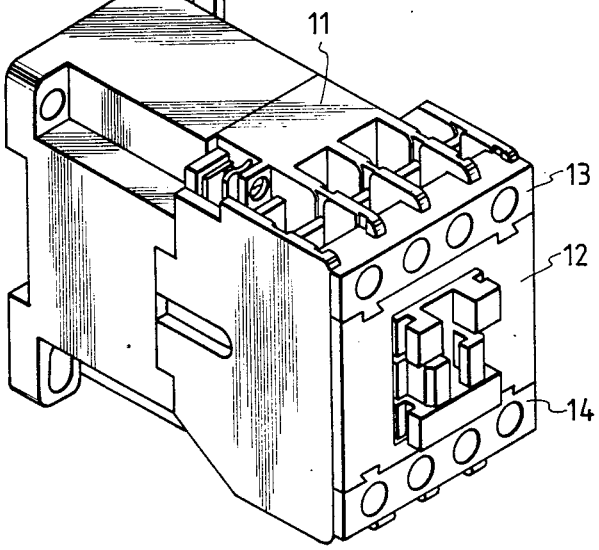
FIG. 2 is a perspective view of the electromagnetic contactor of FIG. 1 with the terminal covers attached.
Figure 3:
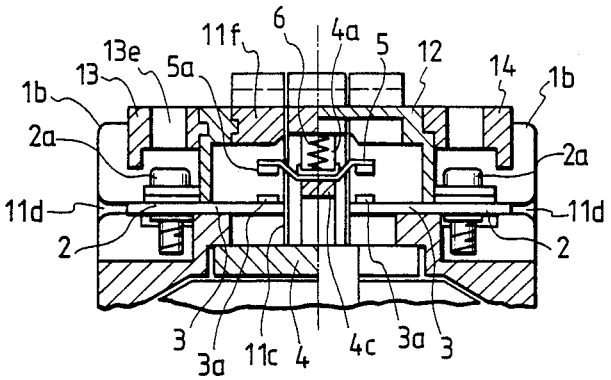
FIG. 3 is a vertical sectional view of the electromagnetic contactor of the present invention depicting the principal components thereof.

Referring to FIG. 1, a body casing generally indicated at 11 includes side walls 11*a* and three pieces of interpole partition walls 11*b* positioned between the side walls 11*a*. A guide groove 11*c* (FIG. 3) for a movable contact support 4 is provided at the center of the body casing 11 and guide grooves 11*d* are provided for positioning and fixing fixed contacts 3 provided on inner walls of the side walls 11*a* and of the partition walls 11*b*. Arc-extinction walls 11*f* include stop grooves 11*e* through which the partition walls 11*b* on both sides communicate with each other for holding the arc-extinction covers. Stop grooves 11*g* and 11*h* that hold the terminal covers 13 and 14 are formed on the facing sides of the side walls 11*a* and the partition walls 11*b*, respectively. Projections 11*i* of the arc-extinction wall 11*f* are for holding auxiliary contact point units (not illustrated) by engaging with the units. In this case, an operation indicating portion 4*b* of the movable contact support 4 is coupled to a movable contact support of the auxiliary contact point unit.

An arc-extinction cover 12 is formed of synthetic resin and consists of a frame member 12*b* having a window 12*a* passing through the projections 11*i* of the arc-extinction walls 11*f* and through the operation indicating portion 4*b* of the movable contact support 4. Verticle walls 12*c* surround the contact points when inserted between the side walls 11*a* and the partition walls 11*b*. The vehicle walls 12*c* extended at right angles at the ends of the frame member 12*b*. An inner wall of the frame member 12*b* is provided with stop projections 12*d* engaging with the stop grooves 11*e* of the arc-extinction walls 11*f*. The outer walls of the vertical walls 12*c* are formed with stop grooves 12*f* and trapezoidal grooves 12*g*, which are intended to hold the terminal covers 13 and 14.

The terminal covers 13 and 14 have the same shape and are formed of synthetic resin. The terminal cover 13, which represents the terminal covers 13 and 14, includes an L-shaped leg member formed with notches 13*a* at both ends and slits 13*b* into which edges of the partition walls 11*b* are fitted. Stop projections 13*c* and 13*d* engage the stop gooves 11*g* and 11*h* formed in the side wall 11*a* and the partition wall 11*b*. A leg of the L-shaped member of the terminal cover 13 is formed with four through-holes 13*e* positioned in line with the terminal screws 2*a* of the screw terminal 2. Trapezoidal projections 13*f* and stop projections 13*g* engage the trapezoidal grooves 12*e* and stop grooves 12*f* of the arc-extinction cover 12.

The assembly of the electromagnetic contactor begins with attachment of the arc-extinction cover 12 to the body casing 11. This attachment is done by inserting the vertical walls 12*c* of the cover 12 between the partition walls 11*b*. The stop projection 12*d*, which touches against the arc-extinction walls 11*f*, moves over the arc-extinction walls 11*f* as the arc-extinction cover is further inserted. Immediately after the stop projections 12*d* pass the walls llf and reach the stop grooves 11*e*, the arc-extinction cover 12 reverts to its original configuration due to the elasticity thereof, with the result that the stop projections 12*d* engage with the stop grooves 11*e*. The arc-extinction cover 12 is consequently mounted on the walls 11*f*.

The terminal cover 13 is attached to the body casing 11 by fitting the trapezoidal projections 13*f* into the trapezoidal grooves 12*g* formed in the cover 12 until stop projections 13*c* and 13*d* engage the side walls lla and the partition walls 11*b*. When the terminal cover 12 is further pressed, the stop projections 13*c* and 13*d* engage with the stop groove 11*g* of the side wall 11*a* and with the stop groove 11*h* of the partition wall 11*b*. Simultaneously, a stop projection 13*g* on the side of the trapezoidal projection 13*f* of the terminal cover 13 moves over the arc-extinction cover 12 and is fitted into the stop groove 12*f* in the arc-extinction cover 12, with the result that terminal cover 13 is mounted on the body casing 11. The terminal cover 14 is also mounted on the body casing 11 in the same manner as the termihal cover 13.

Where an electric wire is to be connected to the thus assembled electromagnetic contactor, a driver may be inserted through the through-hole 13*e* of the terminal cover 13 to loosen the terminal screw 2*a*. Subsequent to this step, the electric wire is inserted between the screw terminal 2 and the terminal screw 2*a*, and the terminal screw 2*a* is then tightened. The terminal screw 2*a* may be removed from the screw terminal 2 for the purpose of connecting an R-shaped contact bonding terminal to the screw terminal 2 by detaching the terminal covers 13 and 14 from the body casing 11.

At the removal of the terminal cover 13, the stop projections 13*g* of the terminal cover 13 are first disengaged from the stop grooves 12*f* of the arc-extinction cover 12 by inserting a screw driver or the like between the terminal cover 13 and the arc extinction cover 12. Then, an end of the cover plate at the side of the slit 13*b* is pushed toward the outside of the body casing 11. As a result, the engagement of the stop projections 13*c* and 13*d* of the terminal cover 13 with the stop groove 11*g* of the side wall 11*a* and with the stop groove 11*h* of the side wall 11*b* is likewise released. The terminal cover 13 may then be pulled out to detach the terminal cover 13 from the body casing 11. The terminal cover 14 is also detached by the same procedure. The removal of the terminal covers 13 and 14 permits the terminal screws 2*a* to be removed from the screw terminal 2 and makes practical the connection of an R-shaped contact bonding terminal. Upon completion of the connection, the terminal covers 13 and 14 may be remounted on the body casing 11.

Figure 4:
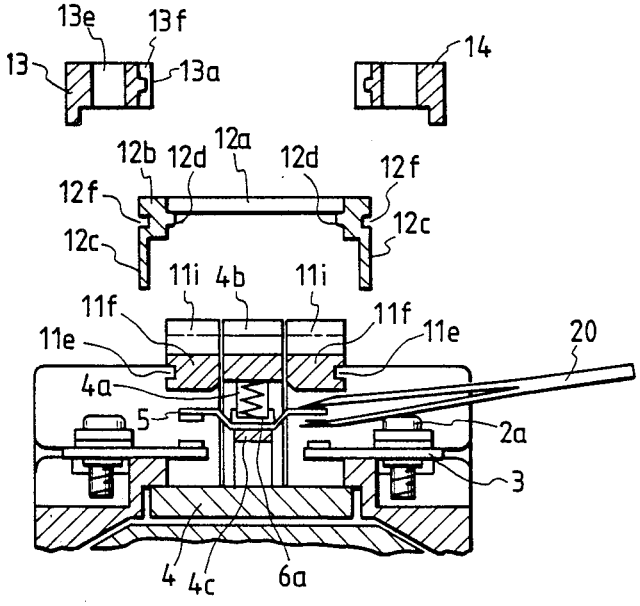
FIG. 4 is an exploded vertical sectional view of the electromagnetic contactor of the present invention where a movable contact has been replaced.
Figure 5:
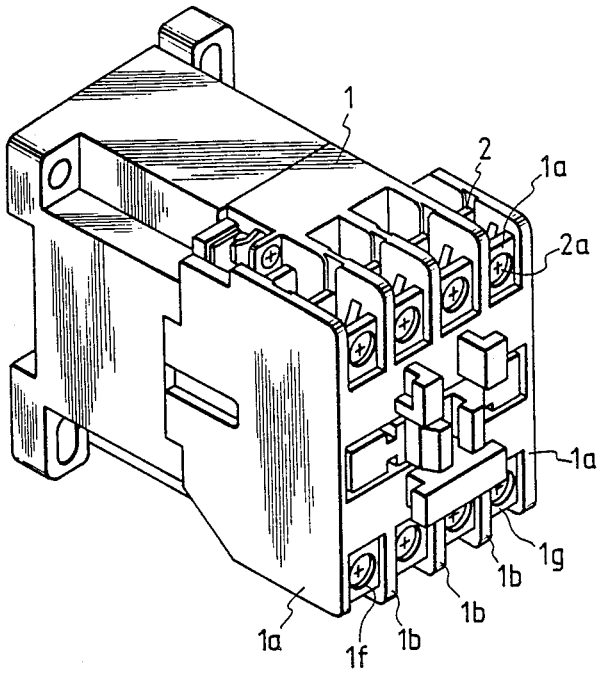
FIG. 5 PRIOR ART
FIG. 5 is a perspective view of a conventional electromagnetic contactor.
Figure 6:
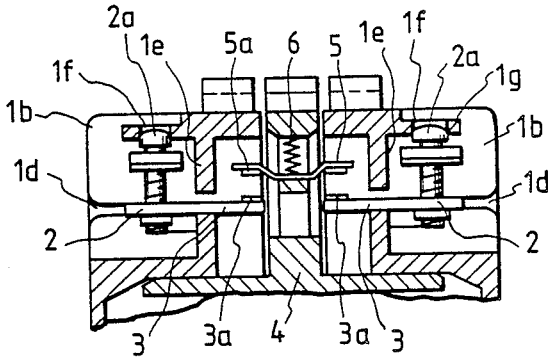
FIG. 6 PRIOR ART
FIG. 6 is a vertical sectional view depicting the principal portion of the contactor of FIG. 5.
Figure 7:
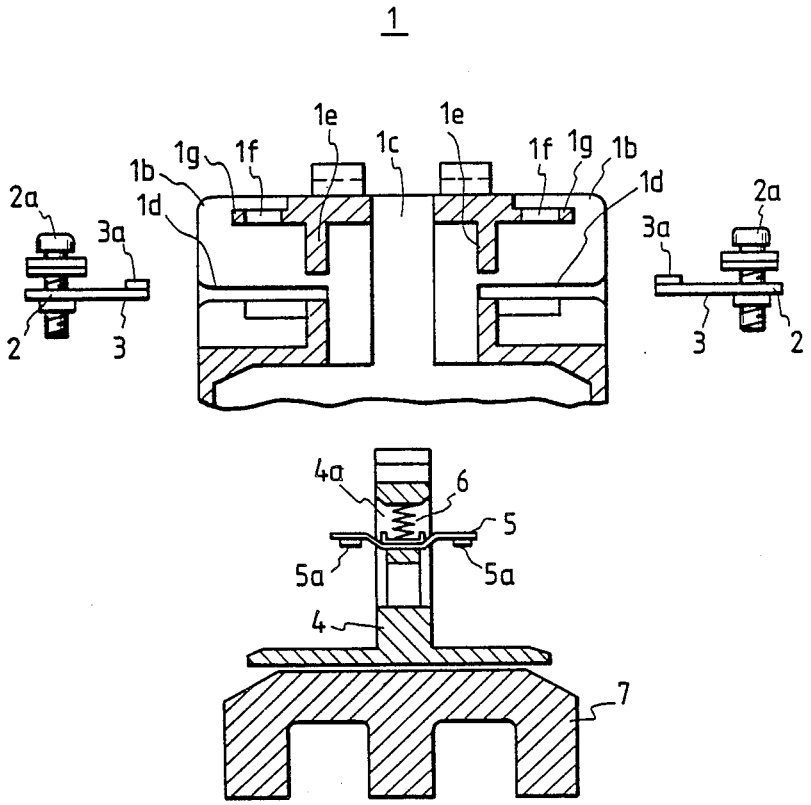
FIG. 7 PRIOR ART
FIG. 7 is an exploded vertical section view depicting the principal portion of the contactor of FIG. 5.

In the case of replacing the movable contact 5, the screw driver may be inserted between the arc-extinction wall 11*f* of the body casing 11 and the arc-extinction cover 12, to remove the cover 12 from the body casing 11 after disengaging the stop projection 12*d* of the arc-extinction cover 12 from the stop groove 11*e* in the wall 11*f*. Removal of the arc-extinction cover 12 is easier if the terminal covers 13 and 14 are detached beforehand. As shown in FIG. 4, after detaching the arc-extinction cover 12 from the body casing 11, a pair of tweezers or the like may be inserted between the arc-extinction wall 11*f* and the terminal screw 2*a* of the fixed contact 3 to grasp the movable contact 5. Since the movable contact 5 is only pressed by a contact spring 6 to be held on a window 4*a* of the movable contact support 4, the movable contact 5 can be removed from the movable contact support 4 by pulling the movable contact 5 with a force sufficient to overcome that of the contact spring 6.

The contact spring 6 does not come off the window 4*a* when removing the movable contact 5, because a spring receiving member 6*a* is attached to the movable contact support 4 to be slidable only in the up-and-down irections. Where attachment of a new movable contact 5 is performed, the tip of the movable contact 5 is inserted between the beam 4*c* of the movable through the window 4*a*. The spring receiving member 6*a* can be raised by the movable contact 5 to allow insertion of the movable contact 5. After the movable contact 5 has been thus replaced, the arc-extinction cover 12 and the terminal covers 13 and 14 are again attached on the body casing 11.

In the electromagnetic contactor as described above, the arc-extinction cover and the terminal covers are separate from the body casing so that the covers may be attached and detached from the body casing. The terminal covers can be mounted as the necessity arises according to the requirements of the customer. Thus, a single electromagnetic contactor unit can be changed into a version that has a terminal cover and a version that has no terminal cover. Unlike the prior art, there is no need for preparing two types of electromagnetic contactors. The terminal covers can be detached to permit the terminal screws to be temporarily removed from the fixed contacts so that connections can be made by using an R-shaped contact bonding terminal. The movable contact attached to the movable contact support can be replaced by detaching the arc extinction cover together with the terminal covers without destroying the electromagnetic contactor.

Although an illustrative embodiment of the present invention has been described in detail with reference to the accompanying drawings, it is to be understood that the invention is not limited to this precise embodiment. Various changes or modifications may be effected therein by one skilled in the art without departing from the scope or the spirit of the invention.

What is claimed is:

1. An electromagnetic contactor comprising:

a contactor body;

a plurality of fixed contacts, each of said fixed contacts having a terminal end and a contact end;

a plurality of movable contacts, each of said movable contacts being associated with a different one of said fixed contacts for making selective electrical connection at a contact point with said contact end of said associated fixed contact; and selectively removable arc-extinction cover means for preventing electrical arcing between said contact point and said terminal end of said fixed contacts, said arc-extinction cover means being detachably secured to said contactor body, said movable contacts making said selective electrical connection when said cover means is attached to and detached from said contactor body, said cover means being removable to allow selective inspection, cleaning, and removal of each of said movable contacts.

2. An electromagnetic contactor according to claim 1, further including terminal cover means for covering said terminal end of each of said fixed contacts, said terminal cover means being detachably secured to said contactor body.

3. An electromagnetic contactor according to claim 2, wherein said contactor body includes a fixed sidewall, a second sidewall, and a plurality of partition walls singly provided between said terminal ends of said first contacts, and wherein said terminal cover means includes a plurality of securing grooves, each of said securing grooves for receiving an edge of a different one of said partition walls when said terminal cover means is attached to said contactor body.

4. An electromagnetic contactor according to claim 3, wherein one of said partition walls and said terminal cover means includes a plurality of locking grooves and the other of said partition walls and said terminal cover means includes a plurality of locking projections for engaging said locking grooves to releasably attach said terminal cover means to said contactor body.

5. An electromagnetic contactor according to claim 4, wherein said arc-extinction cover means includes coupling grooves and said terminal cover means includes a coupling projection for engagihg said coupling groove to attach arc-extinction cover means and said terminal cover means to said contactor body.

6. An electromagnetic contactor according to claim 5, wherein said terminal cover means and said arc-extinction cover means are resilient.

7. An electromagnetic contactor according to claim 1, wherein said arc-extinction cover means comprises a central member and a leg member, said leg member being disposed between said contact point and said terminal end of said fixed contact when said arc-extinction cover means is attached to said contactor body.

8. An electromagnetic contactor according to claim 7, wherein said contactor body includes a securing groove and said leg member includes a securing projection for engaging said securing groove to attach said arc-extinction cover means to said contactor body.

9. An electromagnetic contactor according to claim 1, further including a plurality of terminal screws singly associated with said terminal ends of said plurality of fixed contacts, said terminal screws being removable from said associated fixed contact to enable the connection of wires to said terminal ends of said fixed contacts.

10. An electromagnetic contactor according to claim 2, wherein said terminal cover means is selectively secured to said contactor body according to the need of said terminal cover means.

* * * * *